US008915113B2

(12) United States Patent
Matheisl et al.

(10) Patent No.: US 8,915,113 B2
(45) Date of Patent: Dec. 23, 2014

(54) DEEP-DRAWING DEVICE

(75) Inventors: Michael Matheisl, Vösendorf (AT); Thomas Novacek, Schwechat (AT); Peter Khu, Vienna (AT)

(73) Assignee: Inventio AG, Hergiswil NW (CH)

( * ) Notice: Subject to any disclaimer, the term of this patent is extended or adjusted under 35 U.S.C. 154(b) by 1079 days.

(21) Appl. No.: 12/680,750

(22) PCT Filed: Sep. 15, 2008

(86) PCT No.: PCT/EP2008/062249

§ 371 (c)(1), (2), (4) Date: Mar. 30, 2010

(87) PCT Pub. No.: WO2009/047088

PCT Pub. Date: Apr. 16, 2009

(65) Prior Publication Data

US 2010/0218442 A1 Sep. 2, 2010

(30) Foreign Application Priority Data

Oct. 1, 2007 (EP) ..... 07117647
Oct. 1, 2007 (EP) ..... 07117648
Oct. 1, 2007 (EP) ..... 07117651

(51) Int. Cl.
*B21D 13/02* (2006.01)
*B21D 13/00* (2006.01)
*B21D 22/26* (2006.01)

(52) U.S. Cl.
CPC ..... *B21D 22/26* (2013.01); *B21D 13/02* (2013.01)
USPC ..... 72/385; 72/379.6

(58) Field of Classification Search
CPC ..... B21D 13/06; B21D 13/08; B21D 13/00; B21D 13/02; B21D 13/04; B21D 22/26
USPC ..... 72/347, 385, 397, 379.6, 414; 52/182
See application file for complete search history.

(56) References Cited

U.S. PATENT DOCUMENTS

| | | | | | |
|---|---|---|---|---|---|
| 2,481,049 | A | * | 9/1949 | Stamm et al. | 72/385 |
| 2,948,325 | A | | 8/1960 | Welindt | |
| 3,009,510 | A | * | 11/1961 | Meshulam | 72/385 |
| 3,722,254 | A | * | 3/1973 | Katogir | 72/383 |
| 3,762,206 | A | * | 10/1973 | Wright et al. | 72/382 |
| 4,275,581 | A | * | 6/1981 | Miller | 72/385 |

(Continued)

FOREIGN PATENT DOCUMENTS

| | | | |
|---|---|---|---|
| CH | 358 773 | A | 12/1961 |
| EP | 0 960 664 | A1 | 12/1999 |
| JP | 62 270224 | A | 11/1987 |

*Primary Examiner* — Shelley Self
*Assistant Examiner* — Mohammad I Yusuf
(74) *Attorney, Agent, or Firm* — Ladas & Parry LLP

(57) ABSTRACT

The invention relates to a deep-drawing method and a corresponding deep-drawing device. The deep-drawing device has at least two projections (112) and at least two corresponding lamellar gaps (102) in a die (106), the width and positioning (Pi) of the lamellar gaps (102) being adjustable. Folding of a metal sheet (10) is brought about by closing the lamellar gaps (102). During the subsequent deep-drawing process, the projections (112) are lowered into corresponding recesses (103). Flat metal sheets (10) as well as previously corrugated metal sheets (10) can be folded and deep drawn by means of the deep-drawing device and the deep-drawing method.

14 Claims, 6 Drawing Sheets

(56) References Cited

U.S. PATENT DOCUMENTS

| | | | | | |
|---|---|---|---|---|---|
| 4,361,020 | A | * | 11/1982 | Hirota et al. | 72/57 |
| 4,587,826 | A | * | 5/1986 | Bulso et al. | 72/329 |
| 4,601,190 | A | * | 7/1986 | Schneider et al. | 72/347 |
| 4,603,572 | A | * | 8/1986 | Van Breukelen et al. | 72/385 |
| 4,635,462 | A | * | 1/1987 | Bald | 72/385 |
| 4,720,367 | A | * | 1/1988 | Schenk | 264/545 |
| 4,779,442 | A | * | 10/1988 | Welsh | 72/347 |
| 4,840,055 | A | * | 6/1989 | Michael et al. | 72/345 |
| 4,909,061 | A | * | 3/1990 | Reitter et al. | 72/334 |
| 5,010,714 | A | * | 4/1991 | Medwed et al. | 53/412 |
| 5,048,317 | A | * | 9/1991 | Hirota et al. | 72/347 |
| 6,014,883 | A | * | 1/2000 | McClung | 72/347 |
| 6,167,742 | B1 | * | 1/2001 | Marin | 72/351 |
| 6,244,091 | B1 | * | 6/2001 | McClung et al. | 72/347 |
| 6,269,671 | B1 | * | 8/2001 | Zeiter et al. | 72/347 |
| 6,339,949 | B1 | * | 1/2002 | Takamatu | 72/347 |
| 6,828,523 | B1 | * | 12/2004 | Gysi | 219/121.13 |
| 7,007,535 | B2 | * | 3/2006 | McClung | 72/351 |
| 7,624,768 | B2 | * | 12/2009 | Neet et al. | 72/385 |
| 8,082,770 | B2 | * | 12/2011 | Bowman et al. | 72/385 |
| 2002/0029598 | A1 | * | 3/2002 | Hoffmann et al. | 72/78 |
| 2010/0236318 | A1 | * | 9/2010 | Kubo | 72/358 |

* cited by examiner

100
PE
120
A1
F1
122c
121
106
110
F2
122d
A2
140
122b
130
101
122a

6.
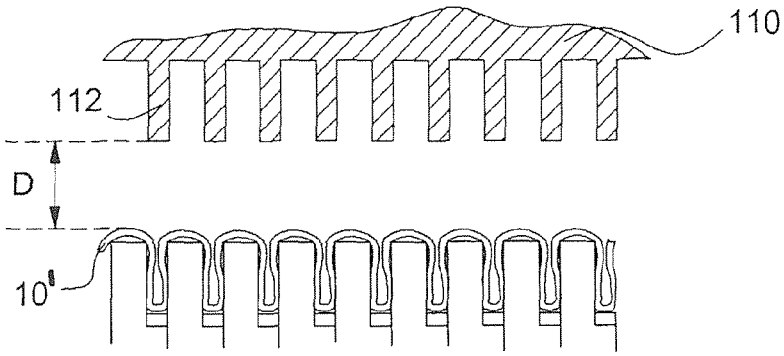
7.
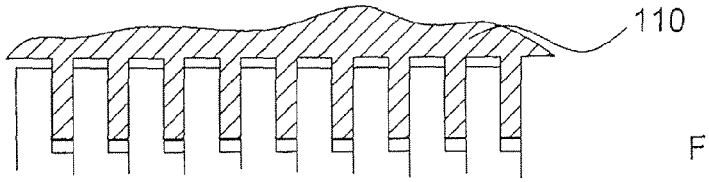
Fig. 6
8.
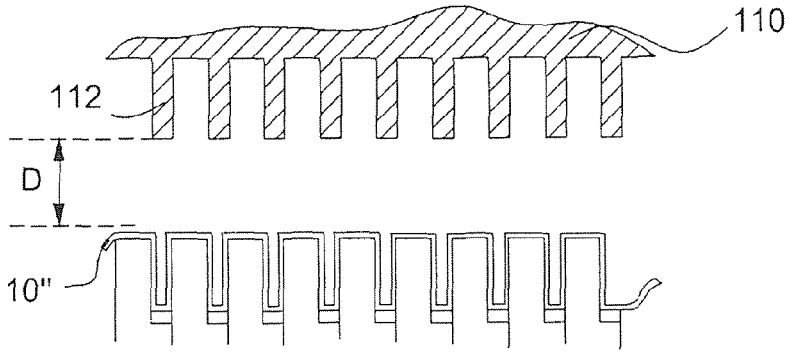
9.
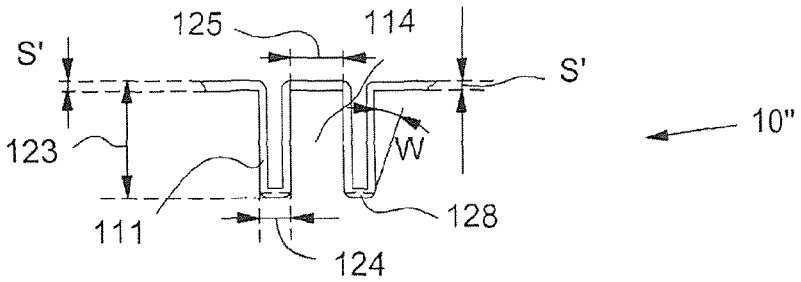

DEEP-DRAWING DEVICE

The present invention relates to a deep-drawing device and to a method with a corresponding deep-drawing device.

BACKGROUND OF THE INVENTION

By deep-drawing there is generally understood a compression-tension reshaping or compression reshaping of flatly shaped workpieces to form a hollow body open at one side or also only the shaping of bulges in the surface of the flatly shaped workpiece, in that a die presses the workpiece into a corresponding die plate.

Deep-drawing in the last-mentioned form finds use in, for example, the production of steps or tread elements and riser elements of escalators or of plates of moving walkways. A tread element forms the tread surface or stand surface for a user of the escalator or of the moving walkway and a riser element forms the visible front face of the step in the inclined part of the escalator. Through the deep-drawing there is achieved, with the stated elements, the shaping of a web/groove profile which notwithstanding its low weight is stiffer and narrower than can be achieved by a stamping method or a pressure moulding method or a rolling method. Moreover, the web profile or groove profile is provided with a plurality—of about 88 to approximately 112—of webs and grooves in an escalator step or moving walkway plate so as to guarantee better standing of the user and to allow liquids, particularly water, to drain away.

The preferred narrow web/groove profile is achieved in that a deep-drawing plate with projections, for example in the form of teeth, tines or prongs, is guided and moved relative to and/or comparatively and/or co-operatively and/or compatibly with respect to a tool with recesses, for example in the form of grooves. Comparatively means that not only the tool can be pressed against a stationary deep-drawing plate, but also that a movable deep-drawing plate can be pressed against a stationary tool. In addition, the tool can have the projections and the deep-drawing plate the recesses and thus be equipped in opposite manner. It is merely fundamental that projections are pressed into corresponding, complementary recesses.

However, a general disadvantage of deep-drawing is that the necessary 'material deformation flow limit' can contradict economic, industrial mass production. In the case of simultaneous deep-drawing of several grooves, which are preferably in a row closely adjacent to one another, the tear strength or yield point or breaking strength limit of the material is quickly exceeded. Consequently, for example, a pressure device is disclosed in the specification JP-A-62270224 in which the steel sheet is pressed onto an individual web tool or stamping tool and each web thus individually formed in succession.

Proceeding from the state of the art and the general problem of 'material deformation flow limit' in deep-drawing the object is set of finding a deep-drawing device or method steps which enables or enable simultaneous production of several, preferably all, desired webs and is thus more economic and faster than previously usual and customary.

BRIEF DESCRIPTION OF THE INVENTION

The fulfillment of the object in accordance with the invention resides in the combination of deep-drawing with a prior adjustability and displaceability of the lamellar gaps of the tool from a receiving position to an end position for shaping the web profile or groove profile. The receiving position is so designed that a metal sheet or deep-draw metal sheet, which is shaped to be wavy or is profiled, is received by its wave valleys or profile valleys in the opened lamellar gaps corresponding with the receiving position. The subsequent adjustment of the tool from the receiving position to the end position means closing of the lamellar gaps, which produces a folding of the metal sheet or deep-draw metal sheet. The tool according to the invention thus stands in the end position, which provides, for the actual deep-drawing process, recesses corresponding with the projections. The simultaneous deep-drawing of each individual groove or each individual web is thereby possible. The metal sheet or deep-draw metal sheet, which lies with its eventual tread side downwardly in the deep-drawing device, thus has more material available. A multiple and tightly spaced deep-drawing taking place simultaneously is thereby newly possible.

This new method is faster and more economic than hitherto and offers increased reserves up to the tear strength limit.

Moreover, the accuracy of the end product or workpiece is increased, since the tolerances of each individual web, as disclosed in the specification JP-A-62270224, do not add together or summate. In the case of the new deep-drawing method according to the invention there are no summation tolerances from the individual production of the webs of the tread element or riser element, whereby there is also no need for costly re-finishing work or straightening work or calibrating work or rectification work.

A preferred embodiment of a deep-drawing device according to the invention substantially comprises a base plate, a deep-drawing plate, a counter-plate with respect to the latter and a tool. The three plates are equipped with a common guide. The deep-drawing plate and the counter-plate enclose the tool together with a workpiece lying thereon. A second drive then presses the deep-drawing plate against the counter-plate or conversely in a direction corresponding with a second axis, which corresponds with the common guide of the plates. The deep-drawing device according to the invention beyond that comprises a further, first guide and a further, first drive. This first drive is, by means of the first guide, in a position of pressing the tool together in a direction corresponding with a first axis perpendicular to the second axis. The last-mentioned pressing together has the consequence of closing of recesses arranged at the tool. As a result, folding of the workpiece lying on the tool is in turn possible.

The drives can be, for example, hydraulic or electrical or via an eccentric and the tool can consist of, for example, displaceably arranged lamellae. These lamellae can in turn run in a separate guide and preferably have two different thicknesses in their respective cross-sectional profile. The smaller of the two is in that case oriented towards the deep-drawing plate. This preferred form of the lamellae has the effect that the lamellae can be pressed with maximum pressure against one another towards their greatest thickness and the smaller thickness thus automatically forms the recess. This embodiment has the consequence that due to a higher bending strength of the lamellae a higher dimensional accuracy of the recesses is achieved during loading by the deep-drawing.

The shape or form of the slender lamella also prevents jumping out or self-release of the workpiece from the processing surface or from the slender lamella.

The displacement movement of the lamellae is, moreover, preferably coupled with compression springs between the individual lamellae. This means that preferably at first the mutual impinging of the first and second lamellae triggers the movement of the second lamella, thereupon the third lamella, the fourth lamella and so forth. The initiating movement of the first lamella transfers itself to the next lamella. The thereby-achieved concertina effect or accordion effect or lattice grate effect facilitates folding of the workpiece or the metal sheet with lower force or driving power. A displaced and successive closing of the recesses is thereby achieved. The opening and removal of the workpiece is possible, and able to be accomplished, without problems and with easy motion as well as smoothly and easily.

This is improved if the compression springs are not arranged between adjacent lamellae, but a compression spring, for example, jumps over the adjacent lamella and presses only on the next one or one beyond that. In addition, the compression springs might not be arranged between two adjacent lamellae for reasons of space.

Moreover, the design, in accordance with the invention, of a deep-drawing device with a tool with adjustable recesses provides that the recesses cannot open out beyond a predetermined open receiving position for the workpiece. Arranged for this purpose is, for example, a wire or a flexible cable which connects the individual lamellae. This wire or this cable on the one hand allows complete closing of the lamellae to the extent of bearing against one another and on the other hand does not allow opening of the lamellae beyond the length of the wire/cable lengths connecting them. An expert is at liberty to integrate other forms of travel limitation, for example in the form of latches, hooks or gate guides, which achieve substantially the same effect.

The simultaneity and homogeneity of the closing and opening of the recesses described in the foregoing can be achieved, in accordance with a further preferred embodiment of a deep-drawing device according to the invention, in that the adjustment is carried out by means of a special spindle drive with serially arranged threaded part members. The lamellae are in this regard arranged individually and guided on the thread of a threaded part member of the spindle, so that one or also several turns of the spindle have the effect that each threaded part member moves the lamella associated therewith from the open receiving position to the closed deep-drawing position of bearing against one another.

The deep-drawing device according to the invention or the deep-drawing method according to the invention can in every case be so adapted with respect to the dimensions of the projections in relation to the dimensions of the recesses that in conjunction with the materials indicated by way of example the requirements of the standards can be fulfilled. This adaptability can be given by the fact that, for example, the deep-drawing plate and the individual lamellae are exchangeable.

Very short operating cycles for the production of tread elements or riser elements can be realised with the deep-drawing device according to the invention, the appropriate pressing pressures and the appropriate material. These shorter operating cycles give, by comparison to operating cycles proposed in the state of the art, the possibility—beyond the advantageous shortness of the operating cycle—of the total number of the desired grooves being able to be produced by a single deep-drawing process.

The deep-drawing device according to the invention functions, for example, with metal sheets pre-shaped to be wavy.

A further advantage in accordance with the invention is the simplified withdrawal of the workpiece. The workpiece or the tread element or riser element can be manually removed from the deep-drawing device; easier and simpler and quicker is manipulation by means of ejectors or pressurised air blowers, which lift up the workpiece and convey it out of the recess and/or out of the lamellae. The workpiece or the tread element or riser element is thereafter gripped by a gripper or a robot arm or a metal-sheet manipulator and withdrawn from the deep-drawing device. The workpieces or the tread elements or riser elements are subsequently deposited and/or smoothed and/or smoothed out and/or stacked and/or collected and/or heaped up and/or palleted.

In a further embodiment of a deep-drawing device according to the invention a planar surface, along which the corrugation elevations can slide during folding, is formed in that the deep-drawing projections are lowerable into the deep-drawing plate. This lowering preferably takes place so that the lower end face of the projections forms, together with the underside of the deep-drawing plate, a planar surface.

The invention is usable for parts of escalators and for parts of moving walkways. In addition, parts for steps and parts for plates can equally well be produced.

BRIEF DESCRIPTION OF THE DRAWINGS

The invention is explained in more detail symbolically and by way of example on the basis of the figures.

The figures are described conjunctively and generally. The same reference numerals mean the same components; reference numerals with different indices indicate functionally equivalent or similar components.

Figure 1:
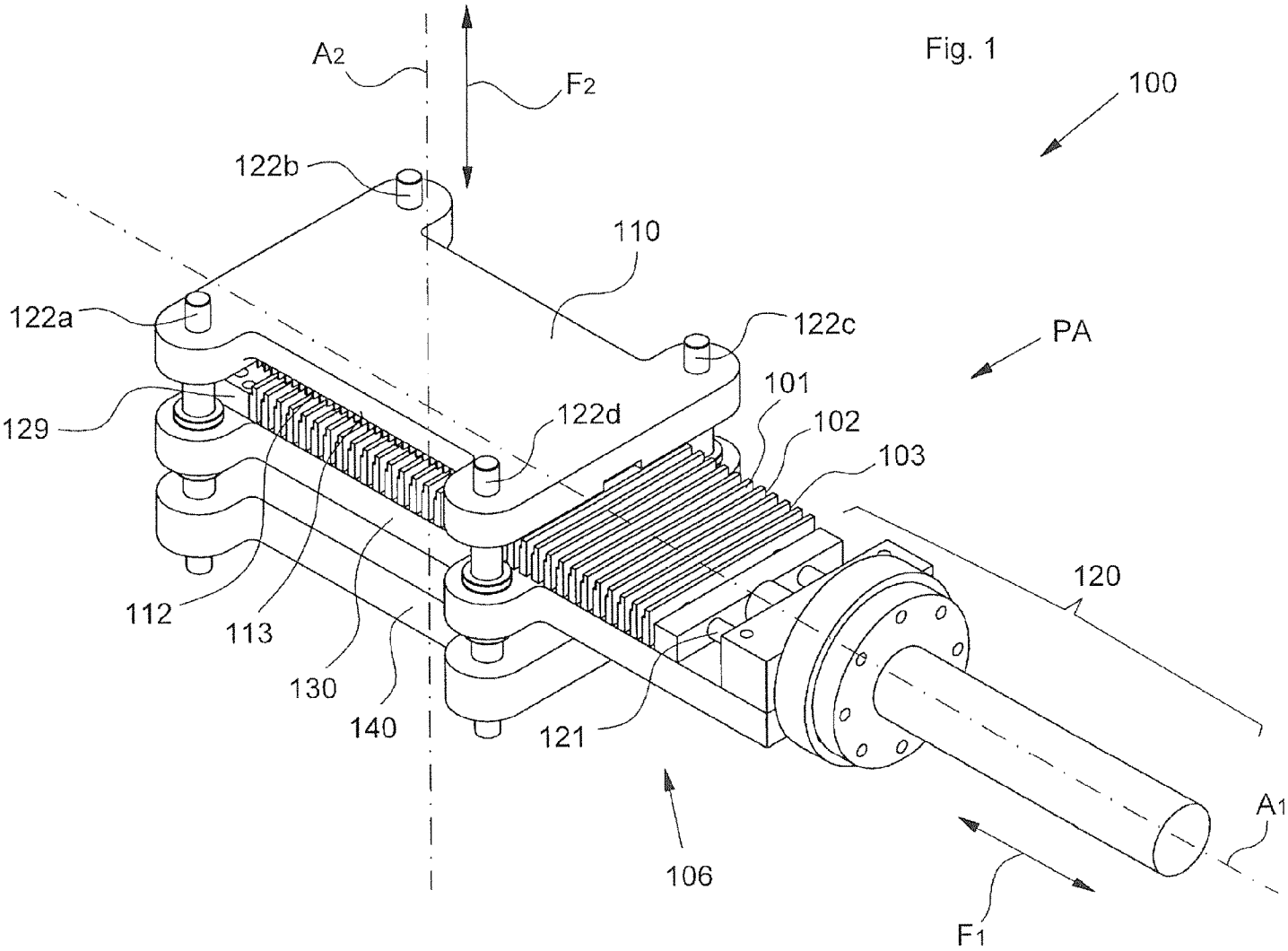
Figure 2:
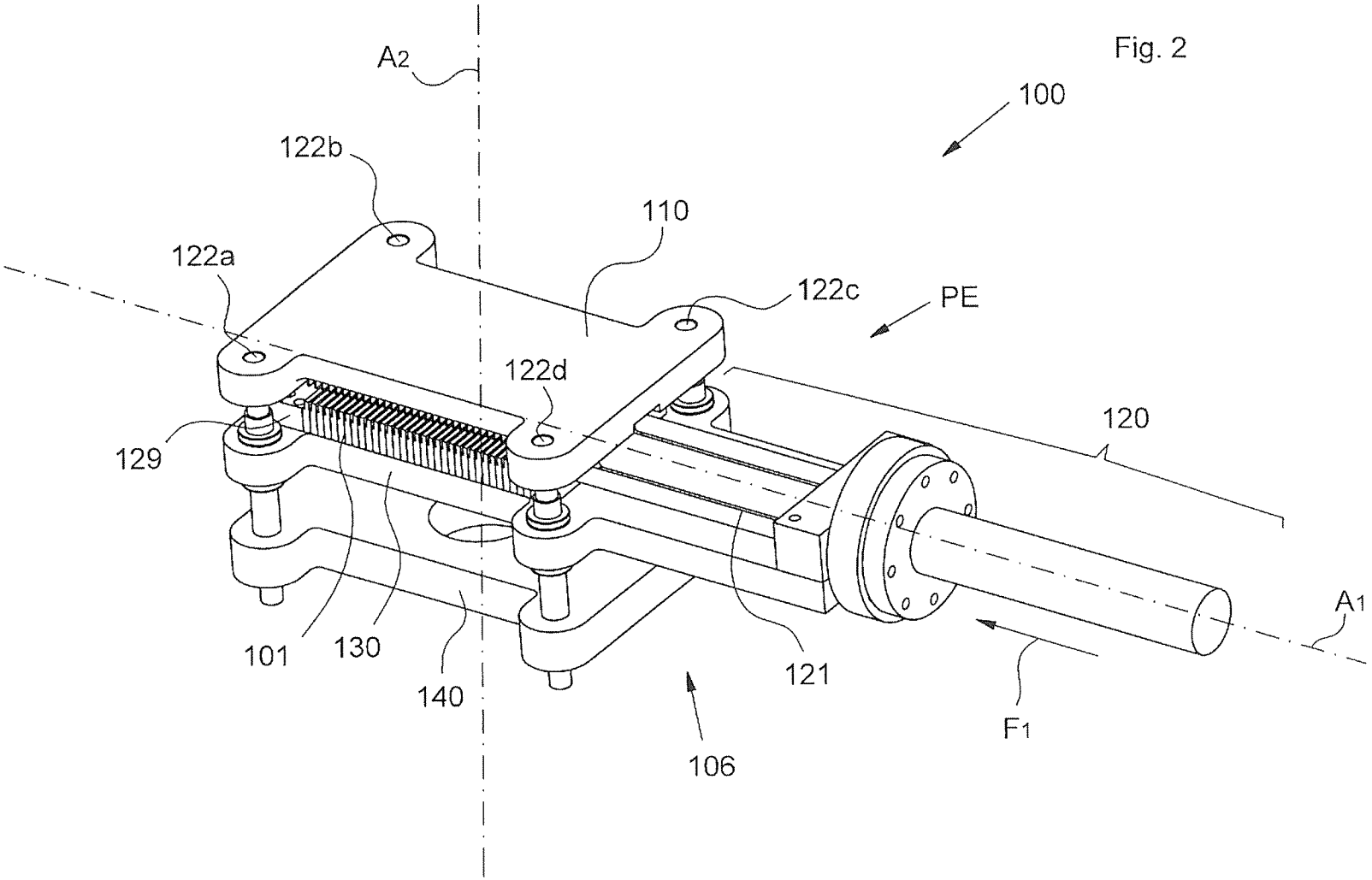
Figure 3:
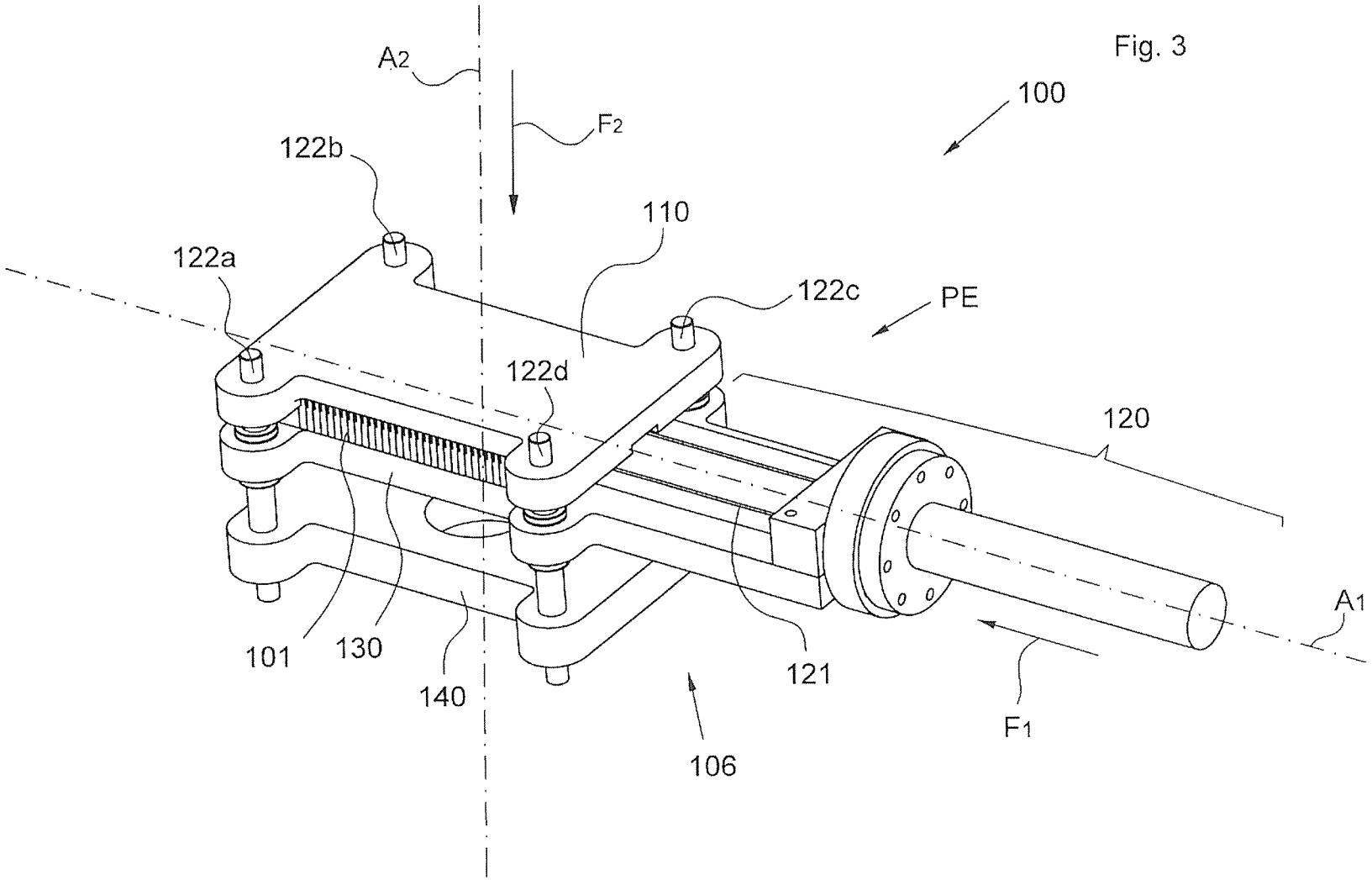
Figure 4:
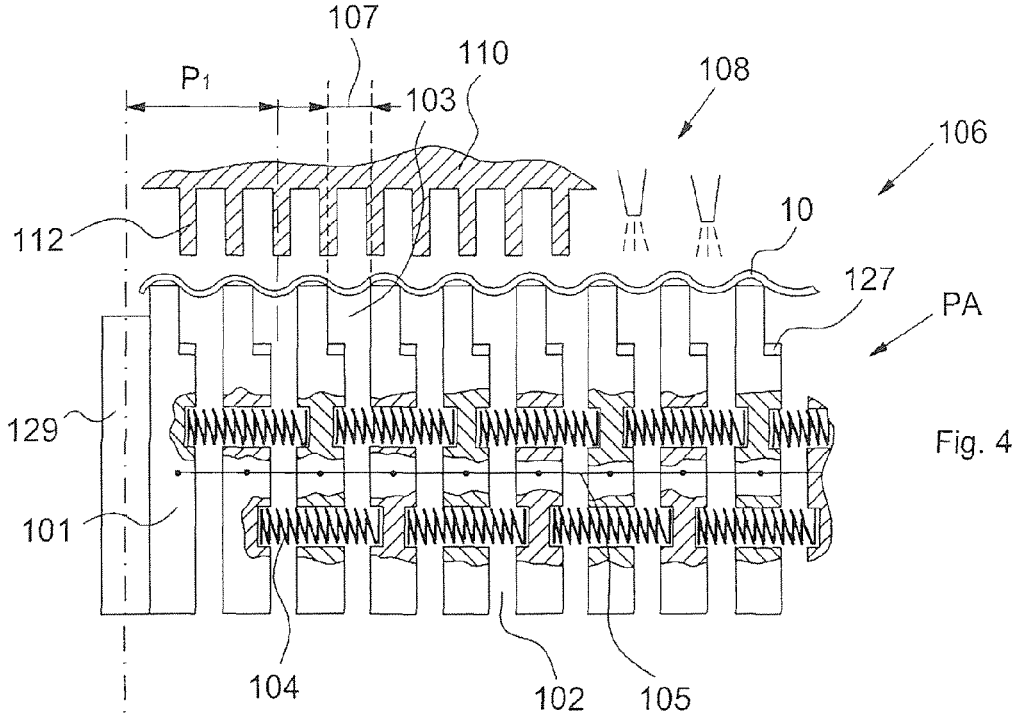
Figure 5:
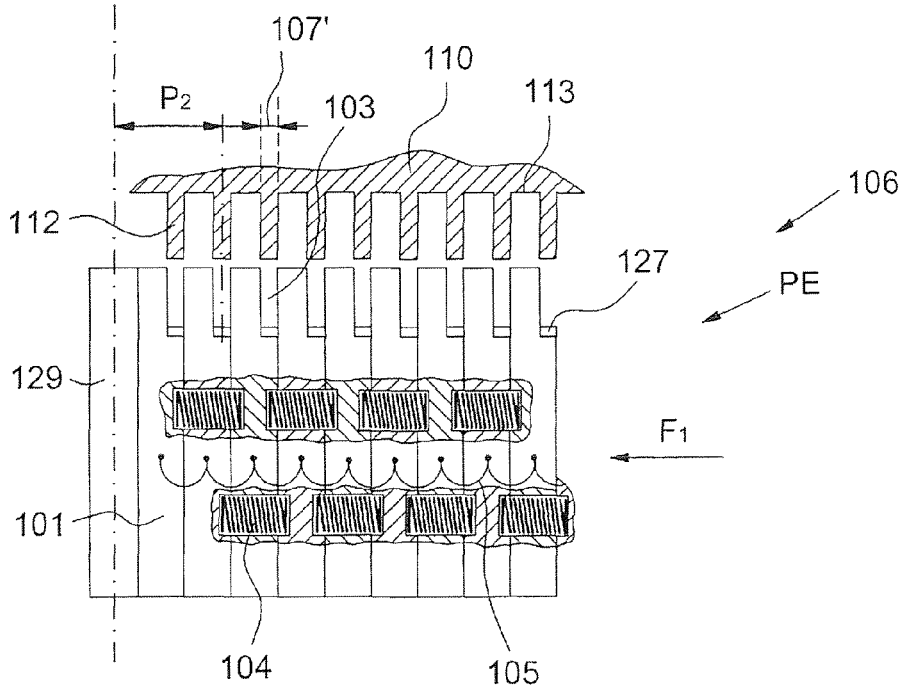
Figure 6:
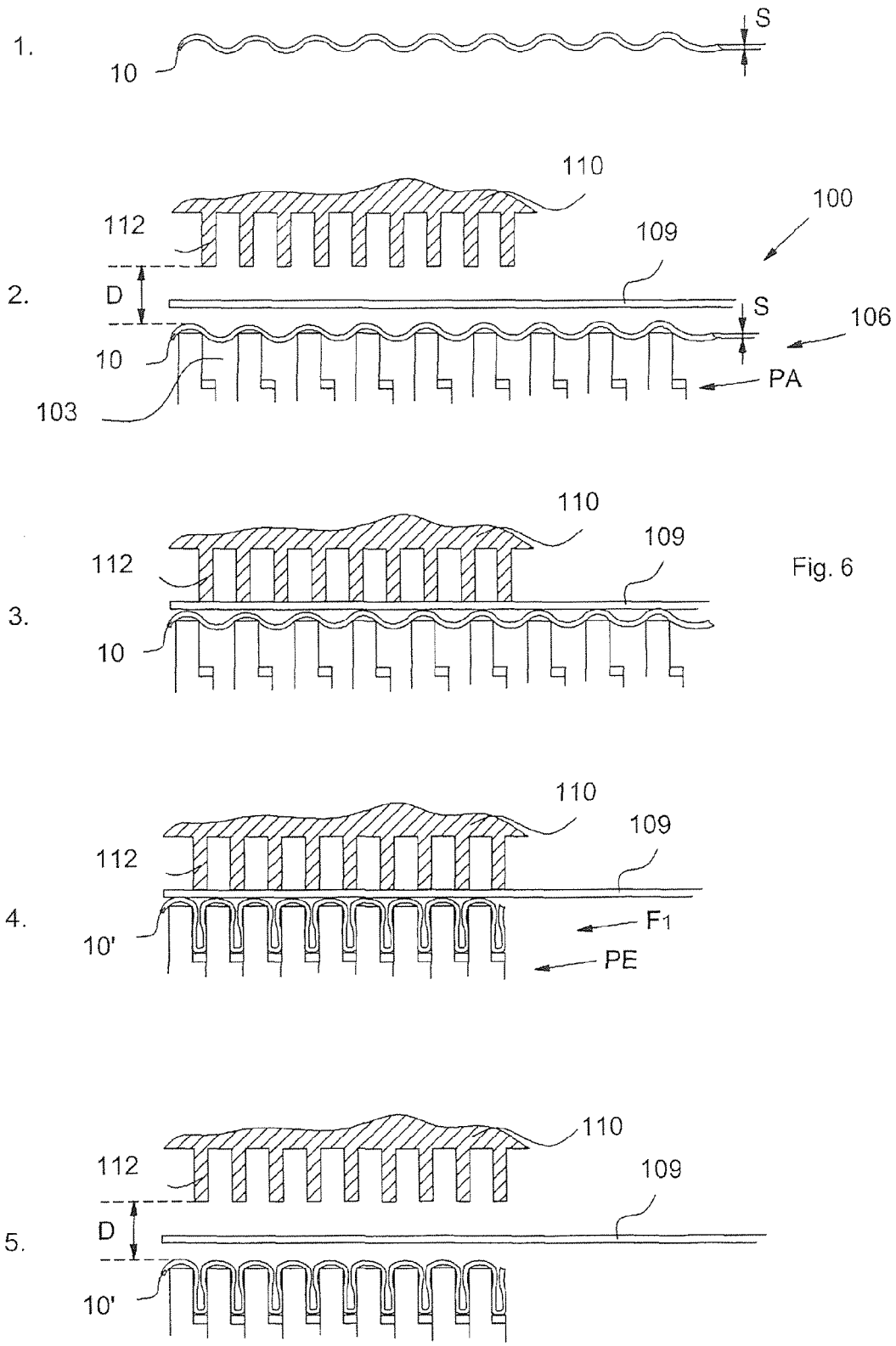

In that case:

FIG. 1 shows a schematic illustration of a deep-drawing device according to the invention in the open receiving position;

FIG. 2 shows a schematic illustration of the deep-drawing device according to the invention of FIG. 1 in the closed end position;

FIG. 3 shows a schematic illustration of the deep-drawing device according to the invention of FIGS. 1 and 2 in a setting corresponding with the deep-drawing process;

FIG. 4 shows a schematic illustration of lamellae, which form a tool and are disposed in the open receiving position;

FIG. 5 shows a schematic illustration of the lamellae of FIG. 4 in closed end position; and FIG. 6 shows a schematic illustration of the individual method steps.

DETAILED DESCRIPTION OF PREFERRED EMBODIMENTS

FIG. 1 shows schematically a deep-drawing device 100 according to the invention. A deep-drawing plate 110 with an underside 113, at which projections 112 are arranged, a counter-plate 130 and a base plate 140 are guided in common in guides 122*a* to 122*d*. A drive, which is not illustrated in more detail, acts by a drive force F2 along these guides 122*a* to 122*d* or along a deep-drawing axis A2 so that the deep-drawing plate 110 and the counter-plate 130 can be pressed relative to one another. A tool 106 comprises lamellae which in an open receiving position PA, shown here, of the tool 106 form lamellar gaps 102 or recesses 103. These lamellar gaps 102 are adjustable, because a ram 120 driven by a further, second drive (also not illustrated in more detail) so acts by a driving force F1 along a fold axis A1 perpendicular to the deep-drawing axis A2 that the lamellae 101 are movable along a lateral guide 121.

FIG. 2 shows schematically the deep-drawing device 100 according to the invention in a closed end position PE. The lamellae 101 bear against one another. This movement corresponds with a folding process of a metal sheet which was pre-shaped to be wavy and which was previously laid in place between the tool 106 and the deep-drawing plate 110.

FIG. 3 shows schematically the deep-drawing device 100 according to the invention of FIGS. 1 and 2, wherein the counter-plate 130 is pressed against the deep-drawing plate 110. This movement corresponds with a deep-drawing process of the metal sheet folded in accordance with FIG. 2.

A part of the tool 106 in the open receiving position PA is illustrated schematically in FIG. 4. It can be seen that the lamellae 101 form two different thicknesses and a dog 127 is arranged at the transition from the smaller to the larger thickness. Springs 104 are so arranged that they are mounted in a mount at a lamella 101 and, passing through the adjacent lamella, at the following lamella. In addition, travel limitations in the form of wire or cable elements 105 are illustrated, which in the depicted open receiving position PA of the tool 106 stand under tensile stress and prevent further opening of the lamellar gaps 102.

The illustrated open receiving position PA further clarifies that the lamellar gaps 102 or the recesses 103 form a width 107, the centre of which is disposed in a defined position P1 with respect to an abutment 129 of the tool 106. Similarly schematically illustrated is the deep-drawing plate 110 with the projections or teeth 112, wherein it is apparent that the teeth 112 do not correspond or correspond purely accidentally with the recesses 103. A workpiece 10 in the form of a metal sheet pre-shaped to be wavy lies by its wave valleys in the recesses 103 so that subsequent closing of the lamellar gaps 102 in accordance with the driving force F1 folds the metal sheet 10. Moreover, an optional compressed air device 108 is indicated, which presses the metal sheet 10 into the recesses 103.

FIG. 5 shows the part of the tool 106 of FIG. 4 in the closed end position PE. FIG. 5 is illustrated on the same sheet as FIG. 4 so that it can be seen that not only the original width 107 of the recess 103 has reduced to a width 107', but also the position P1 with respect to the abutment 129 has displaced to a position P2. In addition, it can be seen that the lamellae 101 bear at the greater thickness thereof against one another and thus the recesses 103 are only still defined by the smaller formed thickness of the lamellae 101. The position of the recesses 103 now corresponds, by contrast with FIG. 4, with the teeth 112 for the deep-drawing. Moreover, it is illustrated that the springs 104 are compressed and the wire or cable elements 105 no longer stand under tensile stress.

FIG. 6 shows, by way of example, method steps 2 to 8 according to the invention or the working steps 2 to 8 of an exemplifying operating cycle according to the invention, starting from a metal sheet 10, which has been pre-shaped to be wavy, according to numeral 1 and going to a deep-drawn metal sheet 10" according to numeral 9. At numeral 1, the metal sheet 10 pre-shaped to be wavy and with a metal sheet thickness S is shown as starting product.

Numeral 2 shows, as first working step, the introduction of the metal sheet 10 into the deep-drawing device 100 and, in particular, so that the wave valleys come to lie on the opened recesses 103. At the same time, as an optional enhancement for the folding process following later a flattening plate 109 is introduced between the metal sheet 10 and the teeth 112 of the deep-drawing plate 110.

Numeral 3 shows, as the next working step, a reduction of a spacing D to a dimension at which the wave elevations contact the flattening plate 109 and the flattening plate 109 in turn contacts the teeth 112 of the deep-drawing plate 110.

The folding process of the metal sheet 10' under the action of the driving force F1 is illustrated at the numeral 4. Numeral 5 shows the subsequent opening of the deep-drawing device 100, whereupon, at numeral 6, the straightening plate 109 is removed.

The position of the significant elements of the deep-drawing device on attainment of the maximum stroke of the teeth 112 in the deep-drawing process is illustrated at numeral 7.

Numeral 8 shows the removal from the mould and numeral 9 a deep-drawn metal sheet 10", as end product, with a reduced metal sheet thickness S', a web height 123, a web width 124 of a web 111 and a groove 114 with a groove width 125. The web 111 has beads 128 at its upper side in the depicted sectional illustration. In addition, the webs 111 have an angle 'W' which has an inclination between 0 degrees and 17 degrees, preferably 2 degrees to 11 degrees. The beads 128 along the upper side of the webs 111 are kept at small spacings and thereby considerably improve slip resistance for users of the tread elements and riser elements.

Simultaneous production of the webs 111 inclusive of the edging with the beads 128 in one working step improves the production advantage and saves valuable production times and brings additional productivity. Beyond this, productive work is increased, since all webs 111 are produced and fabricated simultaneously and at the same time. The production time and fabrication time of the tread elements and riser elements are thereby hastened and accelerated. An improvement of the production process is obvious and is incessantly, continuously and constantly provided.

The deep-drawing device 100 according to the invention functions, for example, with a metal sheet 10 pre-shaped to be wavy. This can be, for example, an approximately 3200 mm wide sheet metal panel, which has been so (pre-) corrugated that it retains only a width of approximately 2000 mm. The thus-shaped wave valleys are received and folded by the edges of the recesses 103 at the tool 106.

A further form of embodiment of a deep-drawing device 100 according to the invention proposes that use can also be made of a smooth, metal sheet 10 which has not been pre-shaped. For this purpose a smooth sheet 10 is placed on the tool 106, the recesses 103 of which are in the open receiving position. The deep-drawing plate 110 again has, apart from the projections 112 for the deep-drawing, lowerable stamping elements (not shown) which are responsible for the corrugating. These stamping elements are so arranged that they correspond with the centre of the receiving position. The deep-drawing device 100, i.e. the deep-drawing plate 110 and the counter-plate 130, are subsequently closed so that the stamping elements effect preliminary deep-drawing of the deep-draw metal sheet 10 into the open recesses 103, to approximately 2 mm to 5 mm, and thus form it to be wavy.

The stamping elements can also be no designed that they merely pass through the deep-drawing plate 110 and are not connected therewith. In every case this form of embodiment provides that the lowerable stamping elements are retracted after the corrugating of the metal sheet 10, so that only the projections for the consecutively following deep-drawing still protrude out of the deep-drawing plate 110.

A further drive, by which the metal sheet 10 is deep-drawn, presses by, for example, a pressure between approximately 200 tonnes and approximately 700 tonnes, preferably by approximately 300 tonnes. A first drive, which folds the metal sheet 10, presses together the tool 106 or the lamellae 101 of the tool 106 by, for example, a pressure between approximately 0.2 tonnes and approximately 2.5 tonnes, preferably approximately 0.5 tonnes to 1 tonne (1 tonne=1000 kg).

The projections for the deep-drawing preferably have a cross-sectional profile which tapers or widens towards the surface of the deep-drawing plate 110. This prevents in certain circumstances during the deep-drawing process jamming of the metal sheet 10 in the recesses 103 of the tool 106. This form of mould also helps, during folding of the corrugated metal sheet 10, to keep this in position. Moreover, the deep-drawing plate 110 and the tool 106 are preferably of a hardened material, which is formed by laser hardening or plasma hardening or induction hardening or coating hardening, in order to guarantee constantly precise grooves and webs even after numerous operating processes. In particular, the edges of the recesses 103 of the tool 106 have to remain hard and sharp-edged as long as possible in order to guarantee a secure footing on the webs of the tool.

A variant of embodiment of a deep-drawing device 100 according to the invention provides projections for the deep-drawing, the cross-sectional profile of which widens towards the surface of the deep-drawing plate 110. This thus yields depressions or webs, which have a trapezium-shaped cross-section, in the workpiece 20 during the deep-drawing.

A further improved embodiment of a deep-drawing device 100 according to the invention has a positive surface profile at the underside of the deep-drawing plate 110, thus between the deep-drawing projections. This profile presses, on attainment of the maximum stroke of the deep-drawing movement, a number of beads or notches in the surface of the web for an improved slip resistance of the tread element webs. If the metal sheet 10 is so placed in the deep-drawing device 100 that its eventual tread side lies downwardly, then the bases of the recesses 103 in the tool 106 have to have correspondingly positive surface profiles, for example dogs. These dogs are preferably arranged at a spacing of about 1 to 3 mm over the depth of the deep-drawing plate underside or over the depth of the recess bases.

A method according to the invention for deep-drawing with preceding folding of the metal sheet 10, which is pre-shaped to be wavy, by a described deep-drawing device 100 provides an additional method step which facilitates the folding process. In this connection, after laying of the metal sheet 10 the deep-drawing device 100 is closed to such an extent that at least one wave elevation of the metal sheet 10 hits against at least one deep-drawing projection of the deep-drawing plate 110. It is thereby achieved that the metal sheet 10 pre-shaped to be wavy is not forced out of the recesses 103 by the closing of the recesses 103 during the folding.

A further method according to the invention for deep-drawing with preceding folding of the metal sheet 10, which is pre-shaped to be wavy, by a described deep-drawing device 100 provides an additional fixing of the workpiece or of the metal sheet 10 by means of the mentioned harmonica effect or accordion effect or lattice grate effect. In that case the first three to five lamellae are closed more quickly and/or more pressurably and thus guarantee gripping or grabbing or engaging or fixing of the workpiece. The workpiece is, by this process or method step, prevented or kept or restrained from jumping out or being forced out or sliding out.

An optional compressed air device, which sucks the metal sheet 10 via holes in the counter-plate or blows the metal sheet 10 via holes in the deep-drawing plate 110, fulfils the same purpose.

A further optimisation in accordance with the invention of the folding process can be optionally fulfilled by a flattening plate which, for example, is introduced simultaneously with the introduction of the metal sheet 10, which is pre-shaped to be wavy, between the wave elevations of the metal sheet 10 and the deep-drawing projections of the deep-drawing plate 110. The deep-drawing device 100 is subsequently closed again until hitting of the wave elevations against the underside of the flattening plate or hitting of the upper side of the flattening plate against the deep-drawing projections of the deep-drawing plate 110. The elevations which form during the subsequently following folding process thus slide along the underside of the flattening plate and catching of the metal sheet 10 in the deep-drawing device 100 is thereby prevented.

A further method according to the invention for deep-drawing a planar (not pre-shaped to be wavy) metal sheet 10 is distinguished by the following steps. Here use is made of a deep-draw plate 110 having a first arrangement of projections 110 and stamping elements, which can be lowered into the deep-draw plate 110. In a first step this first arrangement of the projections 112 and the stamping elements are lowered into the deep-drawing plate 110. The planar metal sheet 10 is then introduced between the tool 106 and the deep-drawing plate 110. The stamping elements are subsequently so adjusted that the planar metal sheet 10 is shaped to be wavy. The stamping elements are now lowered and the spacing D between the tool 106 and the deep-drawing plate 110 is reduced so that the metal sheet 10 shaped to be wavy bears against an underside 113 of the deep-drawing plate 110. The metal sheet 10 shaped to be wavy is further folded by the adjustment of the lamellar gaps 102 of the tool 106 from the receiving position PA to an end position PE. The first arrangement of the projections 112 is now adjusted so that the folded metal sheet 10 is deep-drawn by penetration of the projections 112 of the deep-drawing plate 110 into the end position PE of the recesses 103 of the tool 106.

It is possible to realise—by the described deep-drawing device 100, the stated pressing pressures and the described material—for the production of tread elements or riser elements new, very short operating cycles which are made up, for example, from the following individual work cycles: laying in place or clamping in place the workpiece approximately 0.5 seconds, folding approximately 2 seconds, deep-drawing about 1 second and removal from the mould (opening, withdrawing workpiece) about 2 seconds.

The deep-drawing device 100 according to the invention and the method possible therewith are, as already explained in the introduction, particularly well suited to the production of tread elements and riser elements of escalator steps. These elements are made of relatively thin and light metal sheet, which notwithstanding its property and notwithstanding or as a consequence of the deep-drawing have to fulfill the prescriptions and load tests of European Standard EN 115 and American Standard ASME A17.1-2004. According to these standards the step has to withstand a static and a dynamic test. In the static test the step is centrally loaded by a force of 3000 N acting perpendicularly to the tread element, wherein a deflection of at most 4 mm may arise. After the action of force, the step may not have any persisting deformation. In the dynamic test the step is centrally loaded by a pulsating force, wherein the force varies between 500 and 3000 N at a frequency of 5 to 20 Hz and lasts for at least $5\times10^6$ cycles. After this test the step may have a residual deformation of at most 4 mm.

According to the invention, in general flatly shaped materials come into consideration as the workpiece 10. The term "flatly shaped" is used to embrace not only pre-corrugated, but also planar metal sheet. This can be metal sheet 10 in general, be it cooling metal sheets or sheets for producing heating bodies or facade elements, solar panels, steel staircases, frame elements or platform elements.

Coming into consideration as material for a metal sheet which satisfies these demands are, for example, deep-draw metal sheets of the steel categories H380, H400, DX 52, DX 56, DX 60, H900 or H1100. These steel categories are substantially based on the strength-enhancing effect of microalloying additives such as, for example, niobium and/or titanium and/or manganese and/or nickel. In principle, all commercially available deep-draw metal sheets come into consideration, but also microalloyed steel sheets or metal sheets which are made of stainless steel, copper, aluminium and alloys thereof.

The ratio of the metal sheet thickness (0.25 mm to 0.75 mm) to the deep-drawn height is preferably in the ratio 18 to 39. The sheet metal thickness, and also the dimensions of the sheet metal panel, are on the one hand selected so that they fulfill the standard, but on the other hand so that the deformation through the folding and deep-drawing directly results in a tread or riser element with the desired dimensions. In the case of the stated materials this can be, for example, a sheet metal thickness of less than approximately 0.5 mm, preferably approximately 0.4 mm, and a deep-drawn height (=web height or groove height) of approximately 10 mm to approximately 12 mm, preferably approximately 10.25 mm to approximately 11 mm. The web width lies, for example, between approximately 2.5 mm and approximately 5 mm, preferably at approximately 2.6 mm, and the groove width between approximately 5 mm and approximately 7 mm, preferably at approximately 6.4 mm. It is thus possible to achieve, for example, that, from a sheet metal panel with a width of approximately 3200 mm, exactly a width of approximately 1000 mm or approximately 800 mm or approximately 600 mm or approximately 1200 mm or approximately 1400 mm of a tread element or riser element results after the corrugating and folding as well as deep-drawing.

Reference is made to the fact that in the foregoing a deep-drawing device was described in which the plates are arranged horizontally and also the workpiece comes to lie horizontally on the tool. However, vertically standing arrangements are also conceivable and hereby disclosed.

Moreover, reference is made to the fact that it was described in the foregoing that the tool 106 has (adjustable) recesses 103 and the deep-drawing plate 110 projections. The converse, namely projections at the tool 106 and the (adjustable) recesses at the deep-drawing plate 110, can also be realised, wherein then, however, a guide for an adjustability of the recesses has to be provided for the deep-drawing plate 110.

Furthermore, reference is made to the fact that as described in the foregoing in the case of a deep-drawing device 100 not only the die plate or the lamellae, but also the ram 120 of the tool 106 or the deep-drawing plate 110 or even both can fold together the workpiece 10 by a, for example, horizontal auxiliary-drive or drive. Moreover, the webs preferably have an angle 'W' which has an inclination between 0 degrees and 17 degrees, preferably 2 degrees to 11 degrees.

The deep-drawing device 100 according to the invention thus makes possible a method according to the invention in which the workpiece 10 is laid or clamped in position, then folded by closing of the recesses 103 and only then deep-drawn.

The invention claimed is:

1. A deep-drawing device for flatly shaped workpieces, comprising:

a tool, a deep-drawing plate having at least two fixed projections, the tool having corresponding recesses between lamellae, guides for moving the tool and the deep-drawing plate relative to one another along a travel axis by a first drive such that the projections of the deep-drawing plate move into the corresponding recesses of the tool, the recesses being width-adjustable along a fold axis perpendicular to the travel axis by a second drive in a range between a receiving position width for a workpiece and an end position width, and means for operating the first and second drives whereby the second drive is first activated whereby the workpiece is folded into folds in the recesses as the second drive adjusts the widths of the recesses along the fold axis from the receiving position width to the end position width, and whereby the first drive is subsequently activated to move the projections of the deep-drawing plate into the corresponding recesses of the tool and the folds of the workpiece, deep-drawing the workpiece folds into a final shape of the workpiece.

2. A deep-drawing device according to claim 1, wherein the means for operating the drives provides for adjusting the recesses in their width and in their positions on the tool.

3. A deep-drawing device according to claim 1 or 2, further comprising a compressed air device for directing the workpiece against the tool.

4. A deep-drawing device according to claim 3, further comprising a flattening plate movable into a position between the workpiece and deep-drawing plate for folding of the workpiece and pressure means for supporting the flattening plate against the workpiece at lamellae of the deep-drawing plate.

5. A deep-drawing device according to claim 1 or 2, wherein the projections of the deep-drawing plate are at an underside of the deep-drawing plate and are retractable to a position in which end surfaces of the projections are co-planar with the underside of the deep-drawing plate.

6. A deep-drawing device according to claim 1 or 2, wherein the tool has hydraulically adjustable recesses.

7. A deep-drawing device according to claim 1 or 2, wherein the tool has recesses which are simultaneously adjustable by means of a spindle drive.

8. A deep-drawing device according to claim 1 or 2, wherein the projections have cross-sectional profiles that taper or widen in a direction towards the deep-drawing plate.

9. A deep-drawing device according to claim 8, wherein the angle of taper of the projections is chosen to produce a workpiece web angle between 0 degrees and 17 degrees.

10. A method for deep-drawing a workpiece by a deep-drawing device comprising a tool with lamellae having intermediate adjustable recesses, and a deep-drawing plate with at least two projections, the deep-drawing plate and tool being movable relative to each other by guides and being driven respectively by first and second drives, the method comprising the following steps in the following sequence:

introducing the workpiece between the tool and the deep-drawing plate;

adjusting the recesses of the tool from a receiving position to an end position along a fold axis perpendicular to a deep-drawing axis by means of a second drive to fold the workpiece; and subsequently deep-drawing the folded workpiece by activating the first drive to move the projections of the deep-drawing plate into the recesses of the tool to shape depressions in the workpiece and finalize a shape of the workpiece.

11. A method according to claim 10 for shaping a tread element or riser element of a step of an escalator, comprising the step of retaining the workpiece against the tool by means of a compressed air device after introduction of the workpiece and before preforming the workpiece.

12. A method according to claim 10 for shaping a tread element or riser element of a step of an escalator, comprising the following steps in the following sequence:

a. after introduction of the workpiece:

introducing a flattening plate between the workpiece and the deep-drawing plate and adjusting a spacing between the tool and the deep-drawing plate so that the flattening plate bears against the projections of the deep-drawing plate and the workpiece bears against the thus-supported flattening plate; and b. after preforming the workpiece adjusting a spacing between the tool and the deep-drawing plate; and removing the flattening plate.

13. A method for deep-drawing a workpiece by a deep-drawing device comprising a tool with lamellae having intermediate adjustable recesses, and a deep-drawing plate with at least two projections movable relative to the tool by guides and driven by a first drive, the method comprising the following steps in the following sequence:

setting the recesses of the tool into a receiving position;

introducing the planar metal sheet workpiece between the tool and the deep-drawing plate;

adjusting a first arrangement of the projections so that the planar metal sheet is to be first shaped to be wavy;

drawing the workpiece by relative movement of the tool towards the deep-drawing plate by means of the first drive to form the wavy shape upon the workpiece;

retracting the second arrangement of the projections;

adjusting a spacing between the tool and the deep-drawing plate so that the metal sheet bears against an underside of the deep-drawing plate;

adjusting, by means of a second drive, the recesses of the tool along a fold axis perpendicular to a deep-drawing axis from the receiving position to an end position so that the metal sheet is folded;

adjusting a second arrangement of the projections so that the folded metal sheet can be deep-drawn by penetration of the projections into the end position of the recesses of the tool; and deep-drawing the folded workpiece by relative movement of the tool towards the deep-drawing plate by means of the first drive so that the projections of the deep-drawing plate penetrate the recesses of the tool to shape depressions in the workpiece to finalize the shape of the workpiece.

14. A tread or riser element produced according to the process of claim 10, 11, 12 or 13, wherein the workpiece is chosen from the group consisting of H380, H400, DX 52, DX 56, DX 60, H900 and H1100 steel (fine) deep-draw metal sheets.

* * * * *